United States Patent [19]

Katz

[11] Patent Number: 5,029,818

[45] Date of Patent: Jul. 9, 1991

[54] RAIL SYSTEM FOR STAIRS, BALCONIES AND THE LIKE

[75] Inventor: Howard S. Katz, Riegelsville, Pa.

[73] Assignee: Robern, Inc., Bensalem, Pa.

[21] Appl. No.: 354,946

[22] Filed: May 22, 1989

[51] Int. Cl.[5] ..... E04F 11/18

[52] U.S. Cl. ..... 256/22; 256/65; 52/184

[58] Field of Search ..... 52/184; 256/21, 22, 256/65, 66, 67, 68, 69

[56] References Cited

U.S. PATENT DOCUMENTS

| | | | |
|---|---|---|---|
| 462,412 | 11/1891 | Poindexter . | |
| 642,011 | 1/1900 | Sill . | |
| 699,509 | 5/1902 | Finnegan . | |
| 1,797,883 | 3/1931 | Strubel | 256/65 |
| 2,715,513 | 8/1955 | Kools | 256/21 |
| 3,233,871 | 2/1966 | Schroder . | |
| 3,267,627 | 8/1966 | Hammitt | 52/298 |
| 3,689,032 | 9/1972 | Von Wedel et al. . | |
| 4,194,338 | 3/1980 | Trafton . | |
| 4,269,533 | 5/1981 | Mashiki | 52/738 |
| 4,561,228 | 12/1985 | Kaminaga | 52/235 |
| 4,667,935 | 5/1987 | Moore . | |

*Primary Examiner*—John E. Murtagh
*Attorney, Agent, or Firm*—Robert C. Podwil

[57] ABSTRACT

A rail system for stairs, balconies and the like utilizes standardized components to facilitate rapid and inexpensive assembly. The rail system includes rail sections including upper and lower rails, joined by posts. Transitions comprising connector and corner members accommodate changes in the rake and direction of adjacent rail sections, and provide a continuous upper rail. Connectors and base elements, which also facilitate ease of assembly and adjustment, are disclosed.

17 Claims, 9 Drawing Sheets

FIG. 12
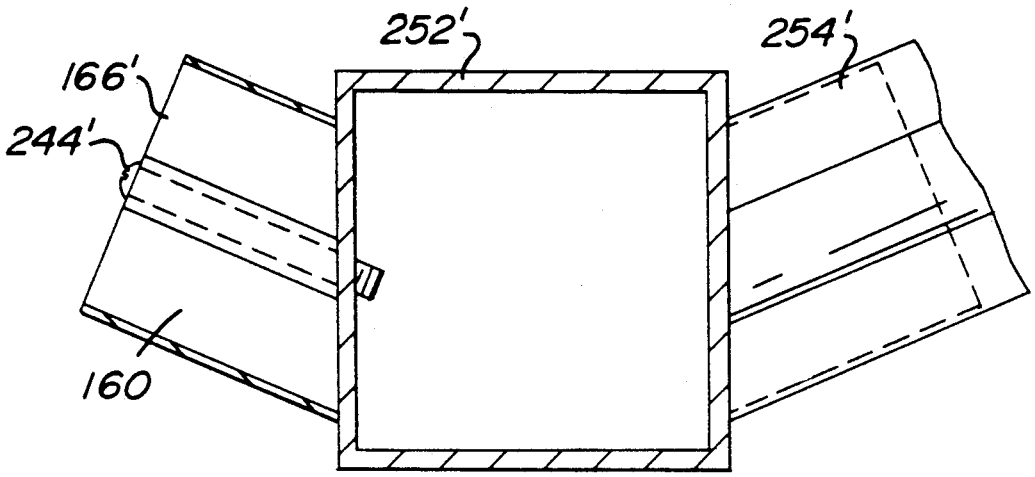
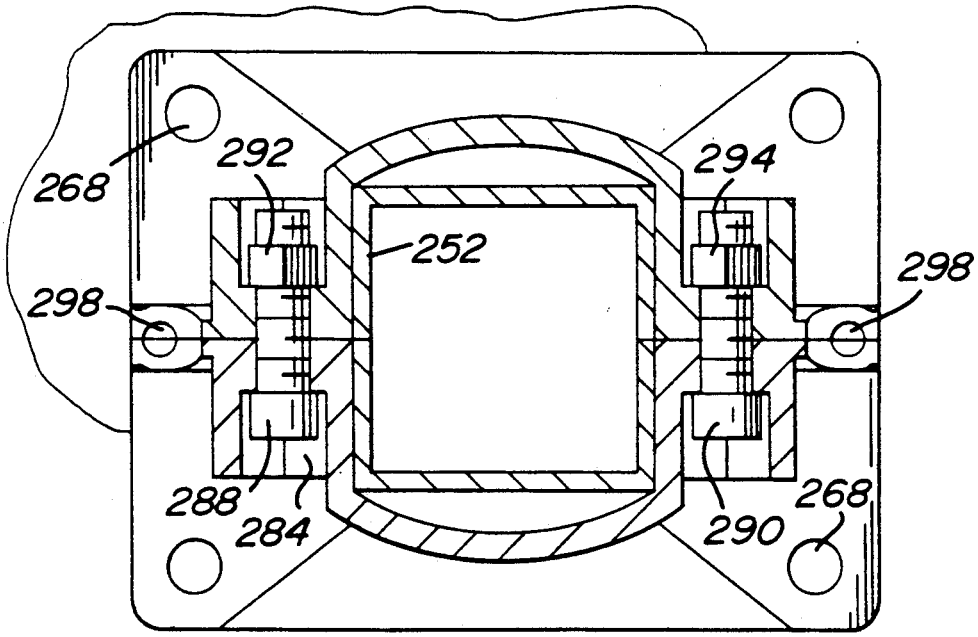
FIG. 13

RAIL SYSTEM FOR STAIRS, BALCONIES AND THE LIKE

BACKGROUND OF THE INVENTION

This invention relates to a rail system and its components, and more particularly to a rail system for stairs, balconies and the like, made from standardized, readily fabricated and easily assembled components, capable of accommodating and functioning in stairwells and landings calling for different rake angles and dimensions. Further attributes of the rail system of the present invention are the provision of a smooth and continuous transition for the handrail at stair landings, and the ability to accommodate the range of unevenness or inexactitude (whether designed or accidental) apt to be encountered in a wide variety of field conditions.

Numerous rail systems have heretofore been proposed. A shortcoming, however, of known systems has been the need for expensive and sometimes difficult custom fabrication to create the configuration and dimensional requirements of each given installation. A particularly difficult requirement to meet is one for a continuous and smooth transition around stair landings, where many building codes require that handrails be continuous and smooth. Taking into account and dealing with particular angles of rake, different turn dimensions and irregularities in surrounding construction is a challenging requirement for any standardized rail system.

BRIEF SUMMARY OF THE INVENTION

In general, the present invention relates to a rail system which in its preferred form simulates a conventional railing of the kind sometimes referred to as a "colonial" design, using rail sections having an upper rail (which serves as a hand rail), a lower rail and upright pickets or posts. Some of the posts may be floor-engaging newel posts, to with the upper and lower rails are affixed. In accordance with the present invention, the rail may be made up of plural horizontal or raked rail sections. Where desired and appropriate, rail sections may be coupled to newel posts by standardized connectors. Sections which meet at stair landings may be interconnected by continuous rail transitions made up of just two stock components: connector elements coupled to the respective rail sections and corner elements coupled to the connector elements. Respective corner elements may themselves be directly connected, or, where the installation calls for it, separated by sections of rail cut to appropriate lengths. All connections between rails and newel posts, and rails and walls, use the standardized connectors, as do end caps for the rails.

the newel posts may be associated with a base made up of identical (self-mating) castings, the base serving if desired as an escutcheon cover or as structural base connection. The base is provided with set screws to selectively provide for fine adjustments to the post position, again to accommodate unevenness in the structure with which the rail is associated or accumulated tolerances.

BRIEF DESCRIPTION OF DRAWINGS

FIG. 12 is a top plan view, in cross-section, illustrating an angled connection between a rail element and a newel post in with the invention.

FIG. 13 is a top plan view, in cross-section, taken along the line 13—13 in FIG. 9.

DETAILED DESCRIPTION

Figure 1:
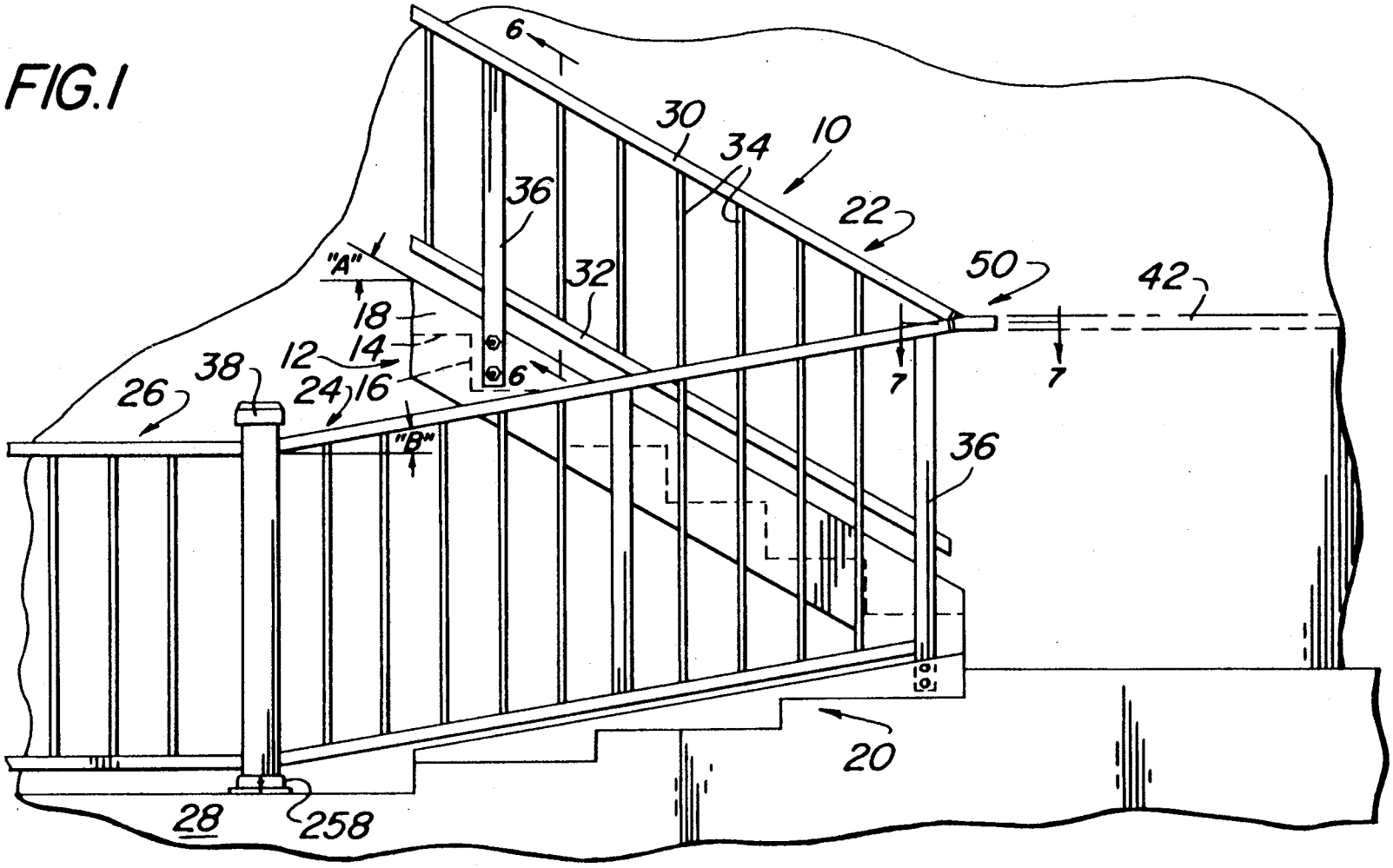
FIG. 1 is a side elevation view of a rail system in accordance with invention.
Figure 2:
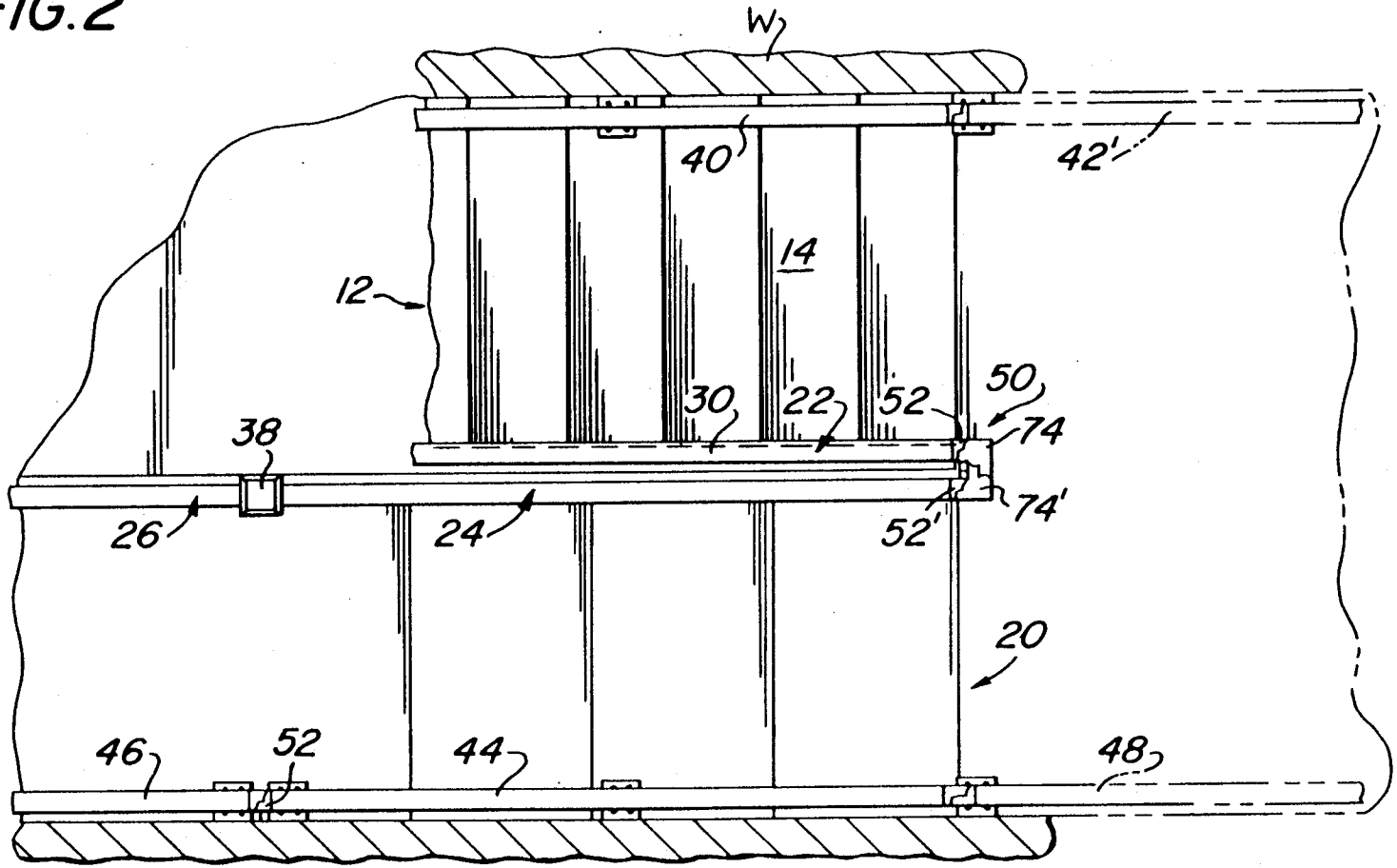
FIG. 2 is a top plan view of a rail system in accordance with the invention.

Referring now to the drawings in detail, wherein like reference numerals indicate like elements, there is seen in FIGS. 1 and 2 a rail system designated generally by the reference numeral 10. For purposes of illustration, the rail system 10 is shown in relation to a flight 12 of stairs having a rake angle "A" with respect to the horizontal. The flight 12 comprises, as is conventional, treads 14 and risers 16, associated with a stringer 18.

A second flight 20 of stairs has, for the purposes of illustration, a rake angle "B" smaller than angle "A" of the flight 12. Associated with the flight 12 is a rail section sub-assembly 22 and associated with the flight 20 is a rail section sub-assembly 24. A rail section sub-assembly 26 completes the illustrated rail system 10, and is associated, for the purposes of illustration, with a level ramp 28.

The illustrated rail system 10 simulates a wooden picket type rail, and each of its sections consists of a hollow rail 30, which serves as a handrail, and a lower or bottom rail 32, interconnected by uprights or pickets 34 at spaced locations. Arranged to support the rail sections 22, 24 and 26 are posts 36, which may, where appropriate, be newel posts such as the illustrated newel post 38. The post 36 is bolted in the illustrated form of the invention of the stringer 18 of the flight 12.

Referring now to FIG. 2, in addition to the above-described rail sections 22, 24 and 26, the flight 12 of stairs may be provided with a rail section 40 adjacent to the wall "W". An additional rail section, shown in phantom and designated by the reference numeral 42, may also be provided. Similarly, rail sections 44 and and 46 may be juxtaposed to the respective rail sections 24 and 26, and a horizontal rail section 48, also shown in phantom, may be coupled to and associated with the rail section 44. The rail sections 42 and 48 may be interconnected if desired, in a manner not shown, to carry the outer rail defined by the sections 42 and 48 around a stair landing.

Figure 3:
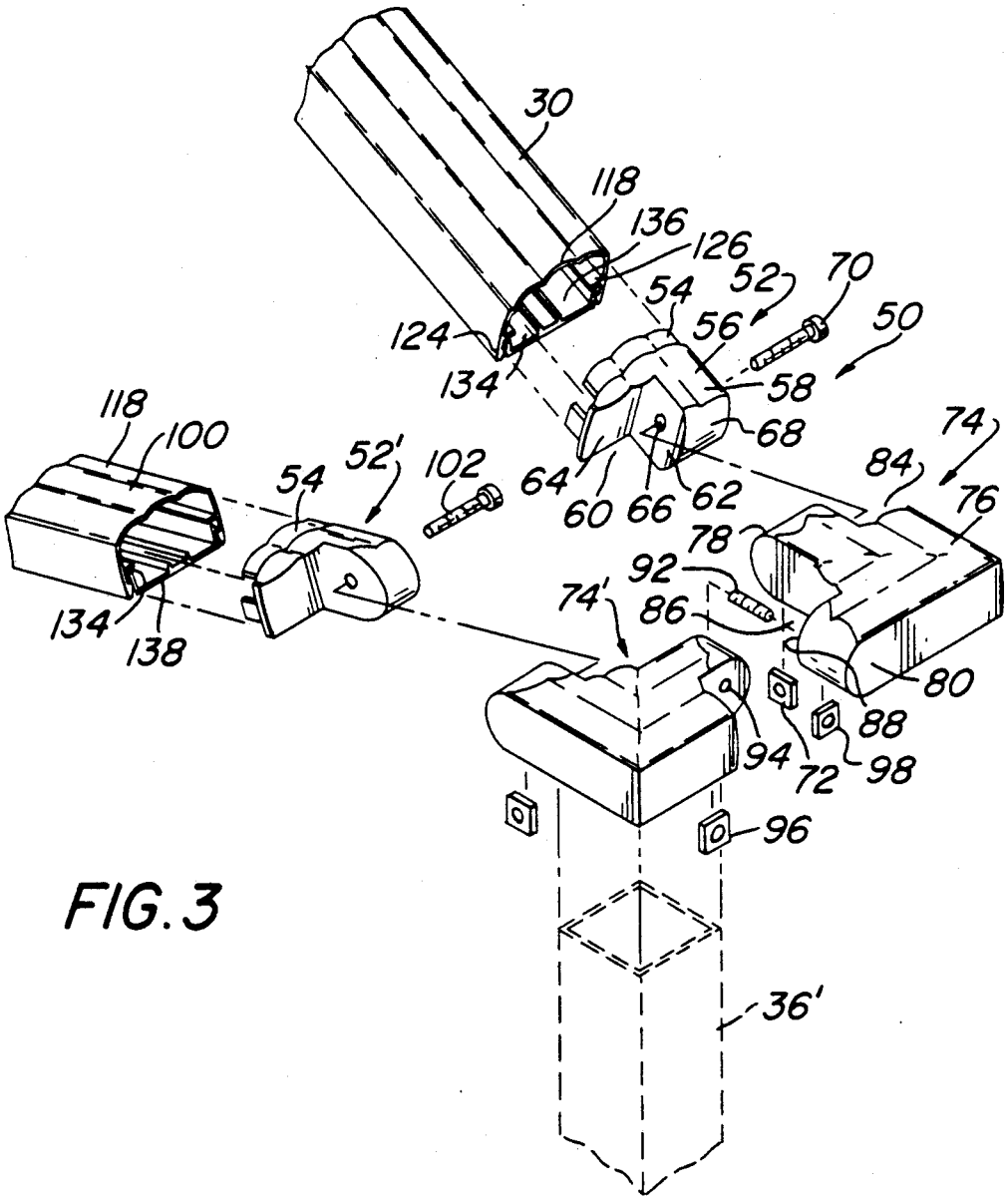
FIG. 3 is an exploded view, in perspective, illustrating details of a transition in accordance with the invention.
Figure 4:
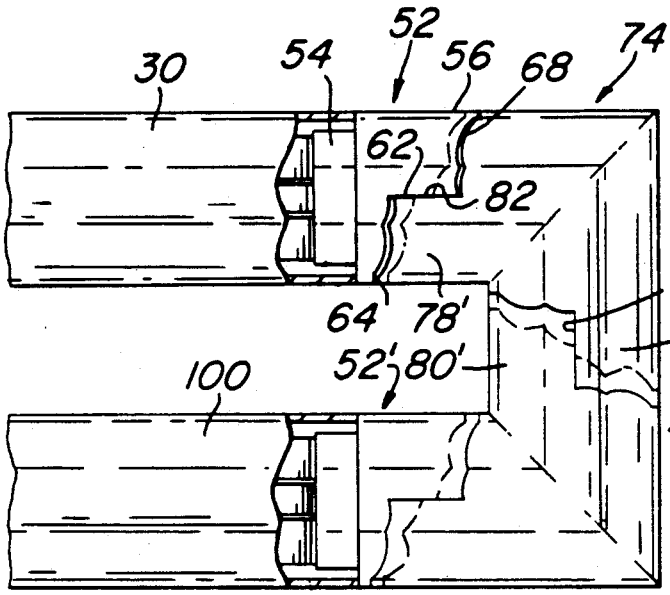
FIG. 4 is a top plan view of rail transition in accordance with the invention.

A rail transition, designated generally by the reference numeral 50, is seen in FIG. 2, and will now, by reference also to FIGS. 3 and 4, be described in detail.

The rail transition 50 provides a continuous upper rail surface as is required by many building codes, and serves to carry the upper rail 30 of the rail section 22 through a 180 degree change in direction and through the transition from the rake angle "A" of the rail to the different rake angle "B" of the upper rail of the rail section 24.

Figure 7:
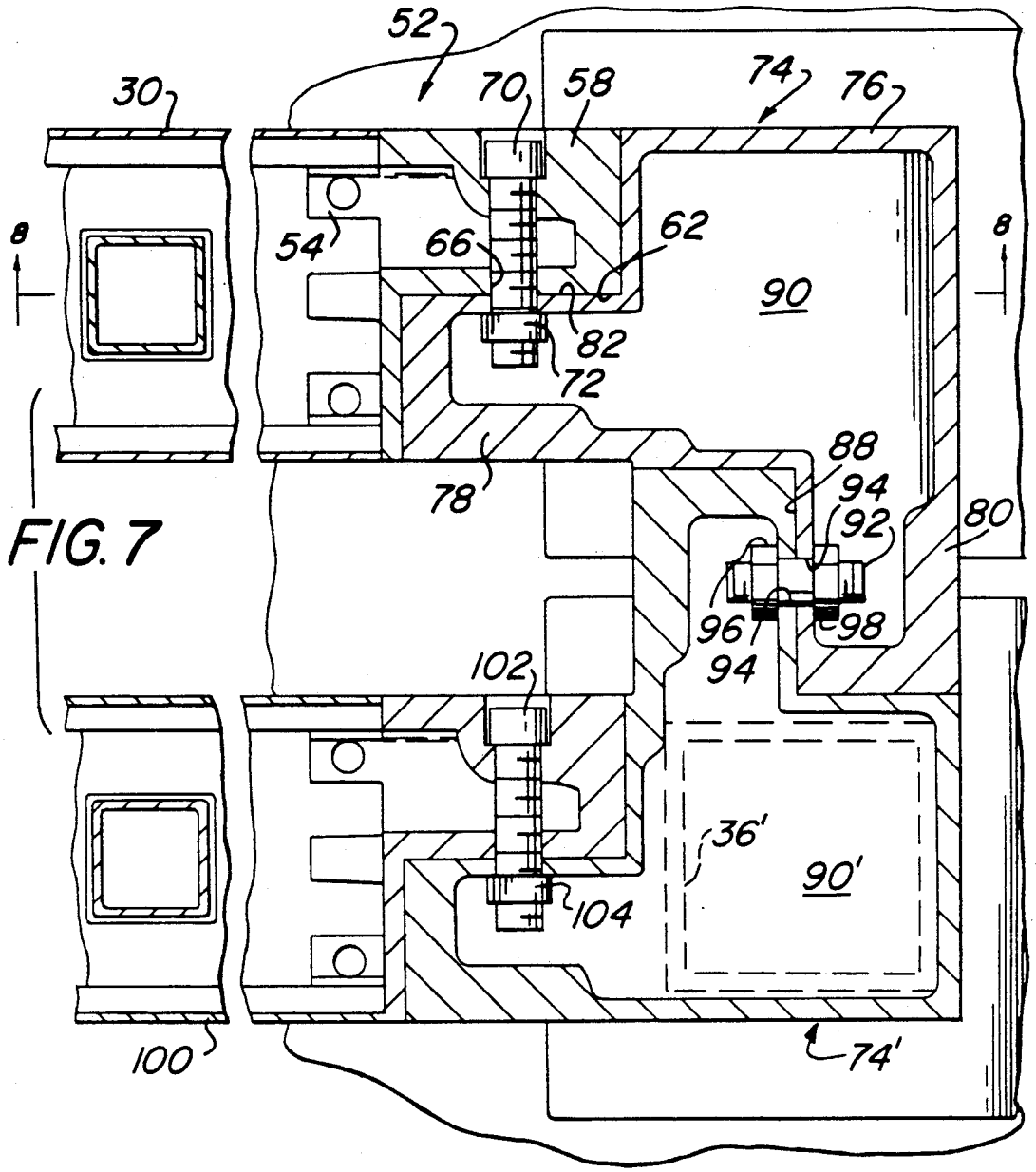
FIG. 7 is a cross-sectional view taken along the line 7—7 in FIG. 1.

Associated with the upper rail 30 is a connector element designated generally by the reference numeral 52. The connector element 52 includes a boss 54, the transverse cross-sectional profile of which corresponds to the interior profile of the upper rail 30. The boss 54 projects from a body portion 56, the transverse cross section of which corresponds to the outer cross section (transverse) of the rail 30. The body portion 56 of the connector element 52 includes a lug 58 extending for one-half of the width of the body portion 56, the remaining half of the width constituting a relieved portion 60 defined by a flat longitudinally extending bearing surface 62 and an accurate relief surface 64. A bolt hole 66 extends transversely through the lug 58. The distal surface 68 of the lug has a curved contour complimental to the arcuate contour of the relief surface 64. A bolt 70 is preferably received in a counter-bore in the bolt hole 66 of the lug 58, to cooperate with a nut 72 (as is best seen, perhaps, in FIG. 7). Referring to FIG. 7, the boss 54 of the connector element 52 may be drilled and tapped to receive fasteners securing it to the upper rail 30.

The connector element 52 is connected to and cooperates with a corner element 74 which will now be described in detail.

As is perhaps best seen in FIGS. 3 and 7, the corner element 74 provides for the transition 50 a first right angle turn and a break from the rake angle of the rail 30. The corner element 74 includes a body portion 76 from which there projects respective lugs 78 and 80, disposed at right angles to each other. The lug 78 is offset toward the inside of the corner defined by the corner portion 74, and when associated with the connector element 52 projects into the relief portion 60 of that element. One face of the lug 78 provides part of the inside surface of the corner element 74. The other face provides a bearing surface 82, abuttable with the bearing surface 62 of the connector element 52. The space alongside the lug 78 at the outside of the corner element 74 may be viewed as a relief portion 84, onto which the lug 58 of the connector element 52 projects.

The lug 80 of the corner element 74 is offset toward the outside of the corner defined by the corner portion 74, and provides part of the surface of outer of the corner element 74. One wall of the lug 80, seen in FIGS. 4 and 7, provides a bearing surface 88.

Figure 8:
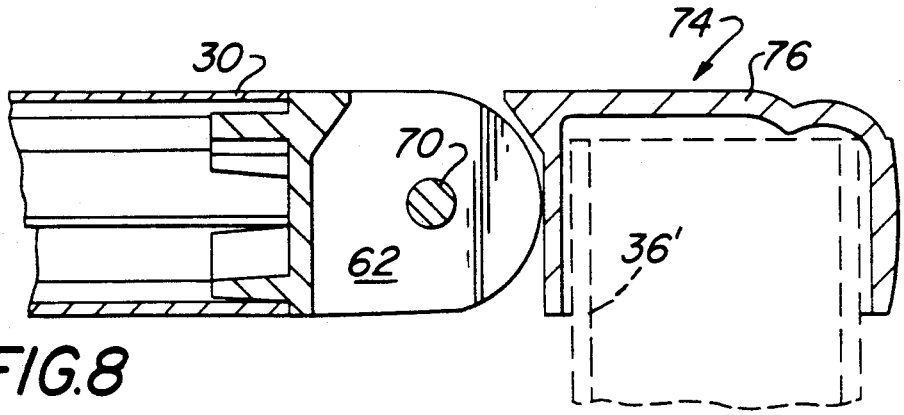
FIG. 8 is a cross-sectional view taken along the line 8—8 in FIG. 7.

The connector element 52 and corner element 74 are preferably made of cast aluminum or other suitable material, and include contoured and finished upper surfaces which form a part of the rail structure, and a hollow underportion 90 (seen in FIGS. 7 and 8). The above-mentioned nut 72 is received in the underportion 90 and ordinarily hidden from view.

The connector element 52 and corner element 74, it should now be apparent, are standardized components, which can be associated selectively with other similar components. Thus, referring to FIGS. 3, 4 and 7, the corner element 74 may be associated with a like element 74', and the corner element 74' associated with a connector element 52'. The corner elements 74 and 74' may be joined, as is best seen in FIG. 7, by a stud 92, associated with bores 94 and 94' in the lugs 80 and 80' of the respective corner elements 74 and 74', respectively.

The stud 92, recessed within the underportions 90 and 90' of the corner elements 74 and 74', joins the lugs 80 and 80' to form of the corner elements 74 and 74' a 180 degree transition. A bolt 102 and nut 104 serve to interconnect the connector element 52' and corner element 74'.

Pivoting adjustment of the connector element 52' about the pivot axis provided by the bolt 102 provides for angular adjustment in the vertical plane between the corner element 74' and the connector element 52' and its associated rail, here designated by the reference numeral 100.

Figure 5A:
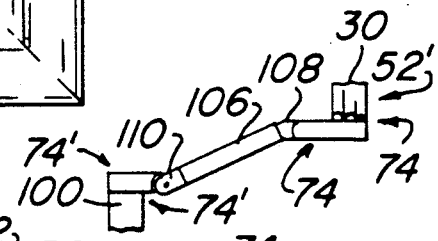
FIG. 5*a* is an end view, in elevation and on a reduced scale, of a rail transition of the kind shown in FIG. 5.
Figure 5:
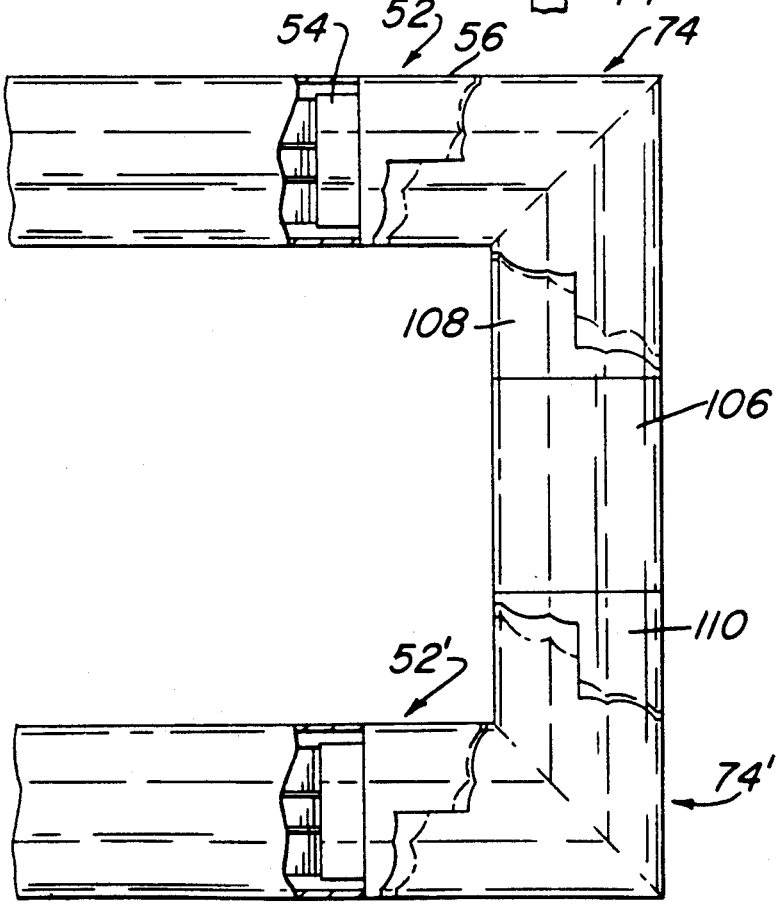
FIG. 5 is a top plan view of another form of rail transition in accordance with the invention.

As illustrated in FIGS. 3, 4, and 7, corner elements 74 and 74' are directly interconnected by means of the stud 92, and the radius of turn of the rail transition 50 is established by the lengths of the lugs 80 and 80' of the respective corner elements. In some applications, however, it may be necessary or desirable to accommodate spacing between the rails 30 and 100 greater than that shown in FIGS. 4 and 7. In such instances, referring now to FIG. 5*a*, a short rail section 106 may be interposed between the corner elements 74 and 74'. In this instance, the section 106 of rail is interposed between the corner elements 74 and 74', and coupled to them by respective connector elements 108 and 110 identical to the connector elements 52 and 52'. The rail section 106 is of a construction identical to that of the rails 30 and 100. The configuration shown in FIG. 5*a* may also be used to advantage to accommodate differences in the height of termination of the respective rails 30 and 100.

It should now be apparent how the rail transition 50 in association with the invention enjoys the benefit of standardization of all of its major components. Rails such as the rails 30, 100 and 106, the connector elements 52, 52', 108 and 110, and the corner elements 74 and 74' are all made from stock components, and may be assembled in alternative configuration as desired.

Referring again to FIGS. 3 and 7 (and also to FIG. 8), it should be noted that the underportions 90 of the corner elements 74 and 74' may be so configured as to provide recesses for the reception of posts such as the post 36' seen in phantom FIGS. 3, 7 and 8. The transitions may also be cantilevered as illustrated in FIG. 1.

Figures 6, 6A, 9:
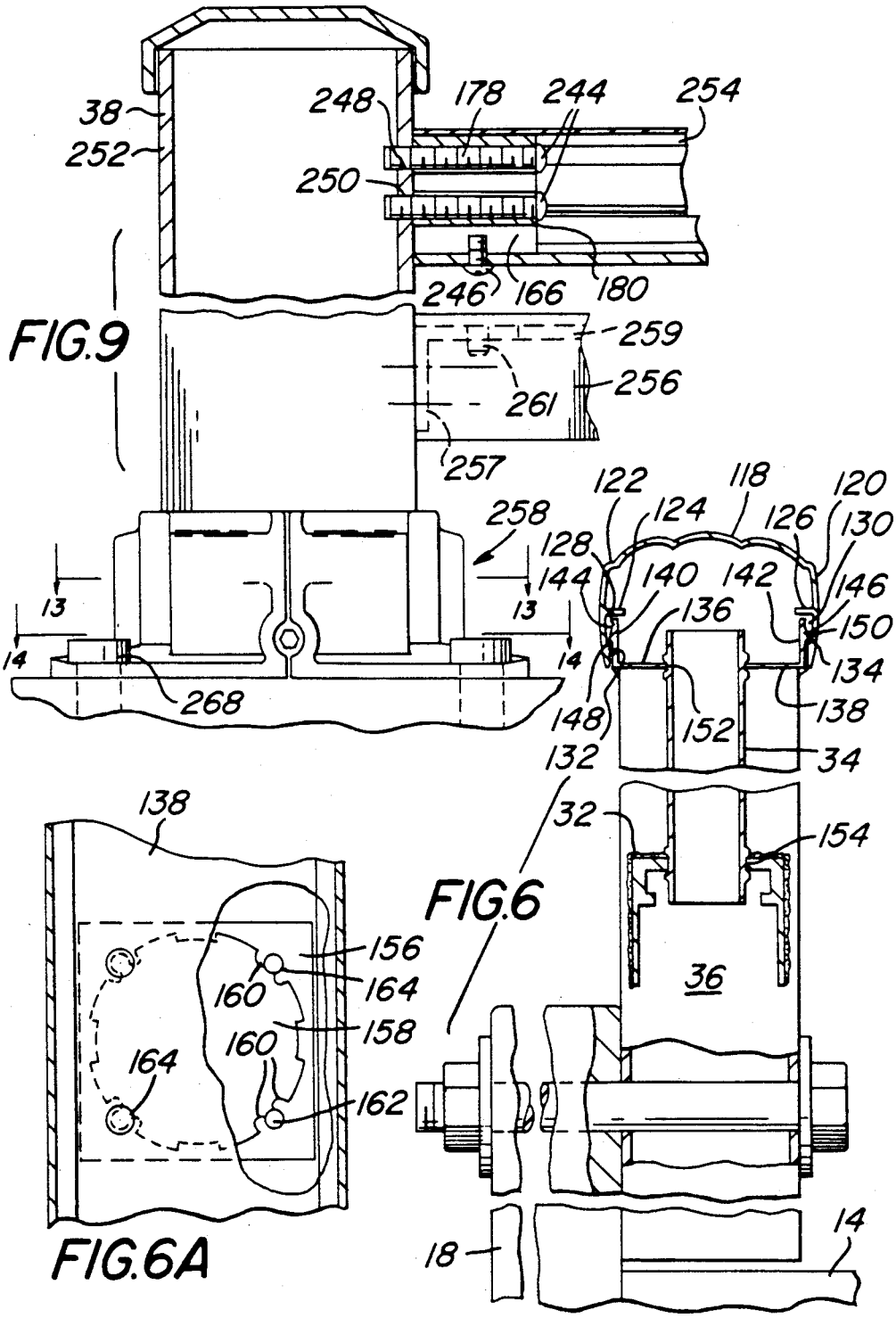
FIG. 6 is a cross-sectional view taken along the line of 6—6 in FIG. 1.
FIG. 6*a* is a detail view, in bottom elevation of an aspect of the present rail system in one of its forms.
FIG. 9 is a detail view, in side elevation and partly broken away, illustrating an aspect of the invention.
Figure 10:
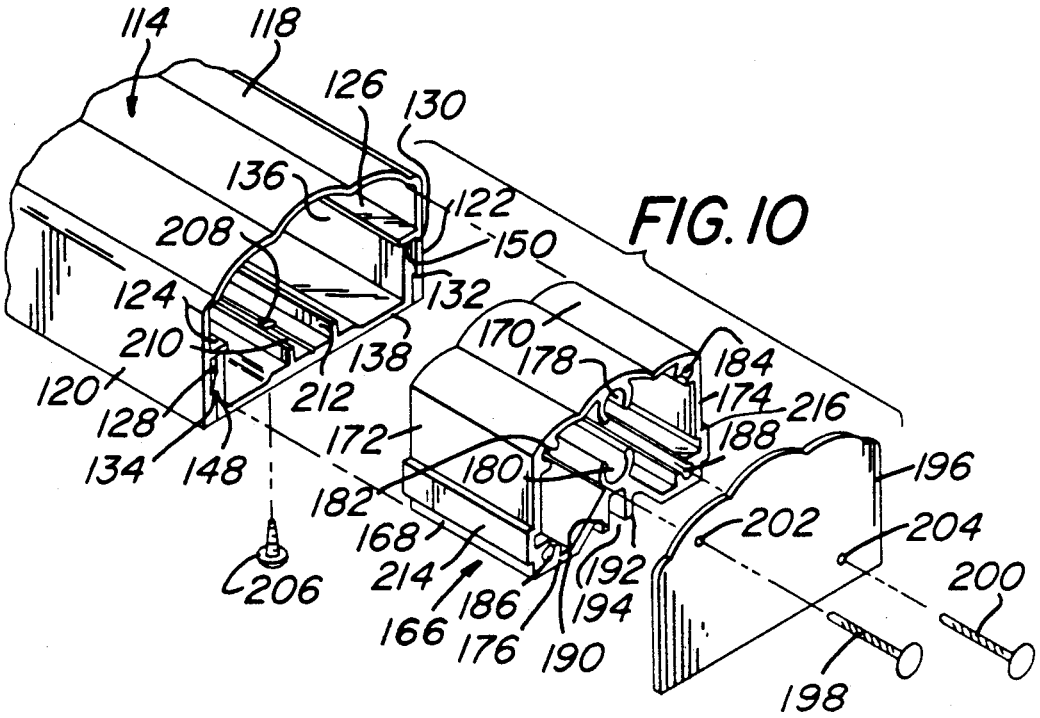
FIG. 10 is an exploded view, in perspective, illustrating details of a connector element used in the invention.
Figure 11:
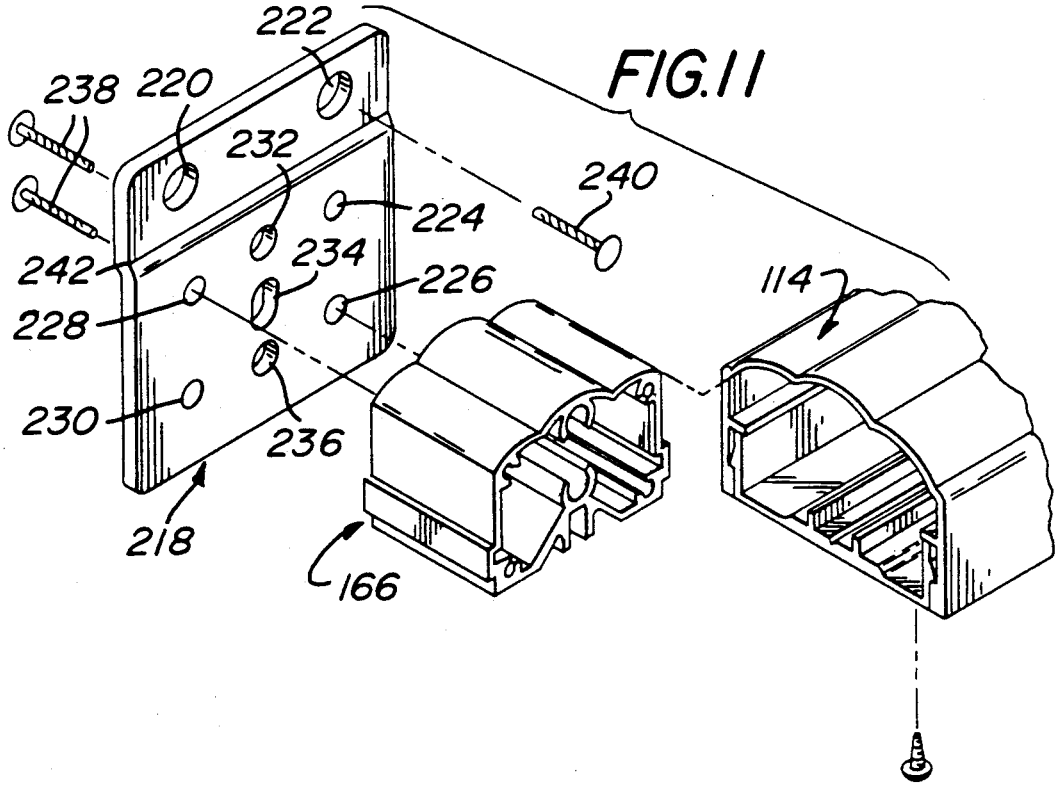
FIG. 11 is an exploded view, in perspective, illustrating the use of a connector element to affix a rail to a wall.

FIGS. 9, 10 and 11 illustrate other aspects of the present rail system which account in part for its versatility and economy. Referring to FIG. 10, a rail, of which the illustrated rail 114 is typical, includes an extruded cap member 116 comprising a crowned upper wall 118 and spaced depending side walls 120 and 122.

The side walls 120 and 122 include inwardly projecting ribs 124 and 126, and also recesses 128 and 130 providing respective horizontal lands 132 and 134. The rail 114 further includes a tray-like rail base member 136. Like the rail cap 116, the rail base member 136 is fabricated by extrusion. The rail member 136 includes, in the illustrated and presently preferred form, a bottom wall portion 138, and a pair of upwardly extending side wall portions 140 and 142. The side wall portions 140 and 142 include, at medial locations, downwardly and outwardly flared angular surfaces 144 and 146, which terminate in downwardly facing surfaces 148 and 150 (best seen in FIG. 6). The manner in which the rail cap 116 cooperates with the base member 136 to form a complete rail element should now be apparent. Specifically, the rail cap 116 may be pressed and snap-fitted over the base member 136, causing the lower extremities of the side walls 120 and 122 of the rail cap 116 to ride over the angular surfaces 144 and 146 of the base member 136 until the downwardly facing surfaces 148 and 150 snap, due to the resilience of the material from which the parts are made, into the recesses 128 and 130. The ribs 124 and 126, in juxtaposition to the upper extremities of the side wall portions 140 and 142 of the base member 136, limit downward movement of the rail cap 116 relative to the rail member 136.

FIGS. 6 and 6*a* serve to illustrate details of alternative techniques by which a rail section may be assembled from its component parts. In this regard, referring first to FIG. 6, the picket 34 is depicted as extending into and through an opening 152 in the bottom wall 138 of the base member 136, and as being swaged into permanent engagement with the bottom wall 138. Similarly, the picket 34 extends at its lower end through an opening 154 in the bottom rail 32 and is swaged into a engagement with that member.

FIG. 6*a* illustrates an alternative form of securement, used for a structural a post 156 of a different kind to a bottom wall 138 of a rail base member 136. In this regard, the post 156 is an extruded shape, of sturdier construction than that of the simple thin-wall shaped of picket 34 of FIG. 6. The post 156 includes a hollow central bore 158, around which are circumferentially spaced a plurality of bosses 160 defining channels 162. The channels 162 may received fasteners, such as conventional or impact-driven screws 164, to secure the base members 136 to the upper end of the picket 156.

FIGS. 9, 10 and 11 illustrate a rail connector which may be used to advantage in carrying out the invention. Referring first to FIG. 10, the connector, designated generally by the reference numeral 166, comprises a body member 168, the transverse cross-section of which conforms generally to the internal cross-section of the above-described upper rail 30. In this regard, the body member 168 includes an upper wall 170, whose configuration in the illustrated embodiment compliements the configuration of the crowned upper rail 118 of the rail 30. The connector 166 also includes side walls 172 and 174 and a bottom wall 176.

The transverse profile of the connector 166, in the presently preferred form of the invention, provides seven potential points of attachment for fasteners. A first attachment point is provided by a channel element 178 disposed adjacent to the upper wall 170. A second channel element 180 is associated with the bottom wall 176. Third and fourth channel elements 182 and 184 are disposed adjacent to the intersections of the upper wall 170 and side walls 172 and 174. Fifth and sixth channel elements 186 and 188 are disposed adjacent to the intersections of the bottom wall 176 and the side walls 172 and 174. The channel elements 178–188 can receive screws in a direction parallel to the longitudinal axis of the connector 166.

Projecting downwardly as part of the bottom wall 176 of the connector 166 are a pair of ribs 190 and 192, the space 94 between which defines yet another potential anchorage point for fasteners. Thus, for example, referring again to FIG. 10, if it is desired to cap an end of the rail 30, an end plate 196 may be secured to the connector 166 by screws 198 and 200 extending through holes 202 and 204 in the end plate 196 and into the respective channel elements 182 and 188. The capped connector 166 may then be inserted into the open end of the rail 30, and a screw 206, extending through a hole 208 in the bottom wall 138 of the rail 30, made to secure the connector 166 by engagement with the ribs 190 and 192 defining the space 194. Snug engagement of the connector 166 with the rail 30 may be enhanced by providing in the bottom wall 138 of the rail member 136 a pair of ribs 210 and 212 the spacing of which enables them to flank the ribs 190 and 192 of the connector 196. The connector 196 may itself be provided with a pair of lateral ribs 214 and 216, engageable with the side wall portions 140 and 142 of the rail base member 136, beneath the horizontally projecting ribs 124 and 126 of the rail cap 116.

FIG. 11 illustrates the way in which a connector 166 may be fitted to a rail 114 and a wall-mounting plate 218 to provide a wall termination for the rail 114. The illustrated mounting plate 218 is provided with holes 220, and 222 to facilitate coupling of the plate 218 to a vertical surface. Also provided in the plate 218 are holes 224, 226, 228, 230 and additional holes 232, 234 and 236, all of which may be made to correspond in their locations to the spacing and disposition of respective channel elements 178–188 on the connector 166. Thus, the plate 218 may be affixed to the connector 166 by suitable fasteners, such as the screws 238 shown in FIG. 11, and the assembled connector 166 and plate 218 inserted into the open end of the rail 114 and mounted to a wall, as by anchor screws 240. The portion of the plate 218 containing the holes 220 and 222 is offset, at 242, to allow for clearance of the heads of screws 238.

Referring now to FIG. 9, the manner in which the connector 166 may be used to connect a rail to a newel post is seen. In FIG. 9, screws 244 are seen to engage the channel elements 178 and 180 of the connector 166, and project into bores 248 and 250 of the newel post, here designated by the reference numeral 252. An upper rail 254, spaced from a lower rail 256 engages the connector 166, and is secured by a screw 246 which projects into the space 194. The lower rail 256 is connected to the newel post 252 by a clip 257, seen in phantom and secured to the newel post 252 by screws, not shown. The clip 257 projects into an internal channel 259 in the lower rail 256, and the clip 257 and lower rail 256 are secured together by a set screw 261.

FIG. 12 illustrates the manner in which a connector 166' may be made to connect a rail to a newel post at an angle, horizontal or vertical. Referring in this regard to FIG. 12, it is seen that connectors 166', here with their respective post-abutting edges beveled with respect to their longitudinal axes, are coupled to a newel post 252' by screw 244' and may readily receive ends of rails such as the rail 254', similarly beveled. Beveling of the connector in a vertical plan not illustrated may accomodate rake angles, if desired.

Referring now to FIGS. 9 and 13 through 15 a base for use in the present rail system will be described in detail.

Figure 14:
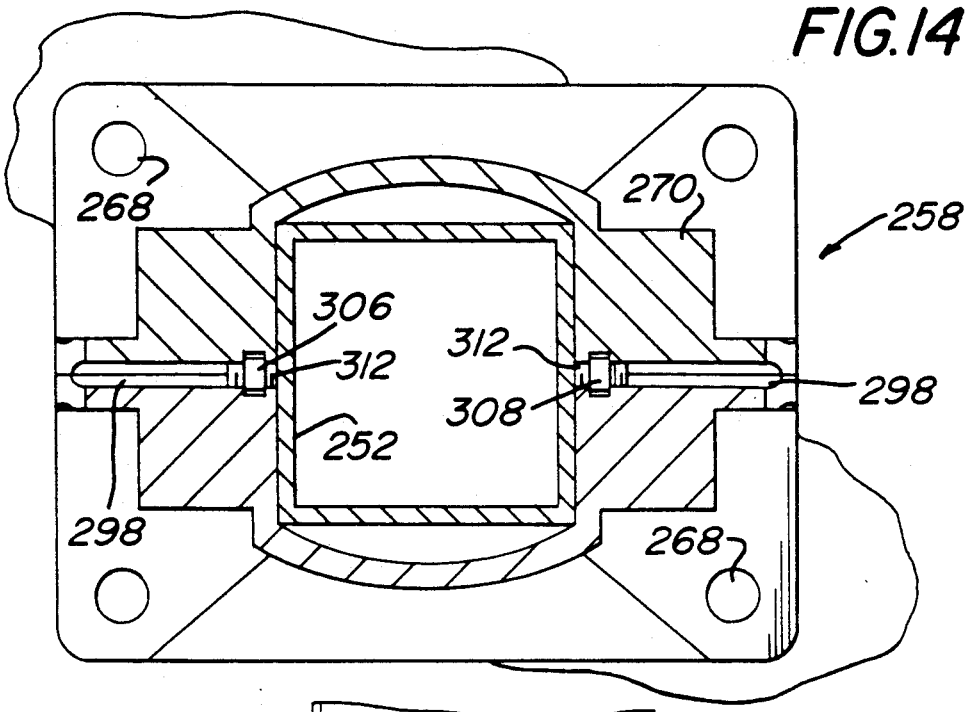
FIG. 14 is a top plan view, in cross-section, taken along the line 14—14 FIG. 9.
Figure 15:
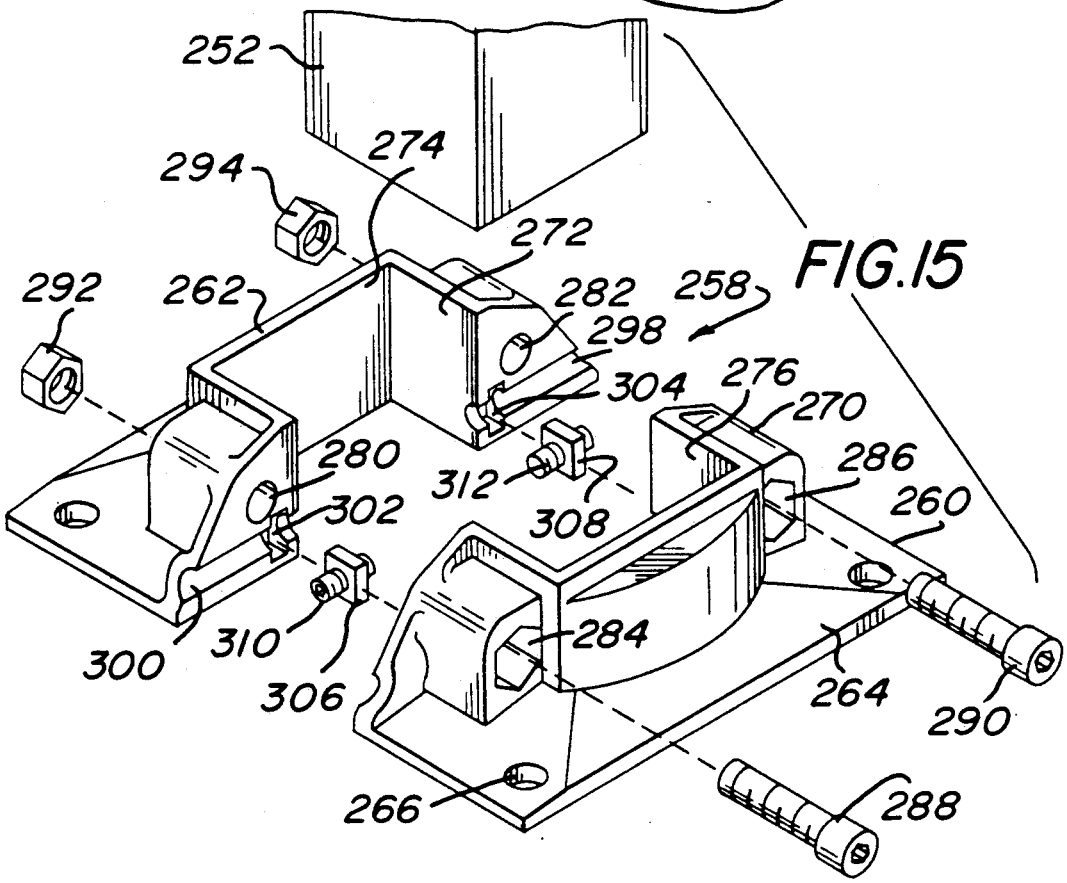
FIG. 15 is an exploded view, in perspective, illustrating a base in accordance with the invention.

Referring first to FIG. 15, the base, designated generally by the reference numeral, 258 is made up of identical cast halves 260 and 262. Each half 260, 262 includes a horizontally extending ground-engaging flange 264, provided with vertically oriented openings 266 adapted to receive anchor bolts. One such opening designated by the reference numeral 266, is seen in FIG. 13. Each base half, 260, 262 is configured with an upstanding boss 270, providing respective vertically oriented wall portions 272, 274 and 276. Each of the halves 260, 262 is provided with horizontally extending bores 280, 282, associated with counterbore portions 284, 286. As is perhaps best seen in FIGS. 13 and 15, cap screws 288 and 290 or conventional bolts may be placed through the bores 280 and 282, 292 and 294. Securement and tightening of the cap screws 288, 290 causes the halves 260 and 262 of the base 258 to clampingly engage a post, such as the newel post 252 seen in FIGS. 13–15.

A set screw arrangement provides for fore and aft adjustment of the post 252 with respect to the base 258. In this regard seen in FIGS. 14 and 15 are a pair of bores 298 and 300, created and defined by half-bores in each of the base halves 260, 262. The base halves 260 and 262 are also recessed, as at 302 and 304, to receive nuts 306 and 308 when the halves are assembled. Received in the nuts 306 and 308 in the illustated embodiment are set screws 310 and 312. It should be apparent that recesses defined by the walls 274 of the respective base halves 260 and 262 are ideally slightly larger in width then the width of the post 252 with which the base is intended to be used. The set screws 310 and 312 thus provide a means for effecting minor fore and aft adjustments of the position of the a 252 with respect to the base 258, as may well be necessary to adjust for unevenness due to ordinary building tolerances.

The various features of the above-described apparatus provide a simple, effective and relatively inexpensive stair and balcony rail system, capable of ready fabrication and easy assembly notwithstanding design differences in particular applications or the range of building tolerances which may be encountered in field applications.

The present invention may be embodied in other specific forms without departing from its spirit or essential attributes. Accordingly, reference should be made to the appended claims rather than the foregoing specification as indicating the scope of the invention.

I claim:

1. For use in a rail system having a raked handrail, a continuous rail transition comprising: respective first and second corner elements providing a level to rake and rake to level transition, a connector pivotably coupled to said first corner element and adapted to mate with a first rail member to provide a rake to level transition, a second connector element pivotably coupled to said second corner element and adapted to mate with a second rail member to provide a level to rake transition, and means coupling together and pivotably interconnecting said corner elements, the pivot axis between said first and second connector elements and said corner elements extending transversely with respect to the directions of the respective rail members with which said connector elements are adapted to mate so that the transition may be adjusted to accommodate different angles of rake.

2. Apparatus in accordance with claim 1, wherein said first and second connector elements are identical and said first and second corner elements are identical.

3. Apparatus in accordance with claim 2, wherein said means coupling together said corner elements comprises a bolt interconnecting said corner elements.

4. Apparatus in accordance with claim 2, wherein said means coupling together said corner elements comprises a rail section, respective third and fourth connector associated with ends of said rail section, and bolts interconnecting said connector elements and said respective said corner elements.

5. Apparatus in accordance with claim 4, wherein said third and fourth connector elements are identical to said first and second connector elements.

6. Apparatus in accordance with claim 2, said corner elements comprising a first lug and a second lug offset at a right angle to the orientation of said first lug, said first lug being an extension of an outer wall of said element, said second lug being an extension of a inner wall of said element, whereby said first corner element is adapted to be coupled to the second lug of said second corner element, and said connector elements having lugs adapted to be coupled, respectively, to the first a lug of one of said corner elements and the second lug of the other of said corner elements.

7. Apparatus in accordance with claim 6, wherein distal ends of said lugs have complimental arcuate contours to facilitate relative pivoting therebetween and provide a smooth and substantially continuous upper surface for said transition.

8. Apparatus in accordance with claim 7, wherein said rail members are hollow, and said connector elements have extensions thereon adapted to be received in ends of the rail members.

9. A rail system simulating a colonial style rail and adapted to accomodate tolerances and variations in stair construction, comprising a plurality of raked rail sections having an upper rail adapted to serve as a handrail, a lower rail, and a plurality of upright posts disposed between and interconnecting said upper and said lower rails, a rail transition adapted to interconnect the upper rails of the respective sections, said transition and said upper rails providing a continuous upper rail surface and said transition providing for a change of direction between said rail sections, said transition comprising respective identical connector elements coupled to the respective upper rails of said sections and respective identical corner elements coupled to said connector elements, said connector elements and said corner elements being adapted to selectively accommodate different rakes of said rail sections and provide a continuous handrail transition and corner between said sections, and base members associated with selected ones of said posts.

10. Apparatus in accordance with claim 9, wherein said base members include set screws for adjusting the position of said selected posts in said base members.

11. Apparatus in accordance with claim 10, wherein said base members comprise identical halves, said halves being coupled together by bolts.

12. For use in a handrail system having a hollow rail, a rail connector comprising an elongated body member having an external transverse cross-section conforming to the internal cross-section of the hollow rail and adapted to be received therein, said connector having respective upper, lower and side walls, said body member having an internal transverse cross-section comprising: first and second channel elements defining connecting points on said connector, said first channel elements being disposed adjacent to the upper wall of said body member and said second channel elements being disposed adjacent to the lower wall of said body member; third and fourth channel elements defining connecting pints on said connector, said third and fourth channel elements being disposed adjacent to intersections of said upper and said side walls of said body member; and fifth and sixth channel elements defining connecting points on said connector, said fifth and sixth channel elements being disposed adjacent to intersections of said lower wall and said side walls of said connector.

13. Apparatus in accordance with claim 12, and an external channel portion associated with the lower wall of said body member, said channel portion defining a connecting point on said connector.

14. Apparatus in accordance with claim 12, and a finishing plate, said finishing plate having a shape complimental with the external cross-sectional shape of the rail, said finishing plate adapted to be coupled to said connector by fasteners by extending through said finishing plate into engagement with connecting points on said body member.

15. Apparatus in accordance with claim 12, and a mounting plate adapted to be coupled to a support surface, said mounting plate having means thereon to facilitate coupling of said plate to a support surface, and holes therein positioned to register with connecting points of said body member, said body member adapted to be coupled to said mounting plate by fasteners extending through said mounting plate into engagement with connecting points in said body member.

16. Apparatus in accordance with claim 13, and a pair of outwardly projecting oppositely disposed flanges on the respective side walls of said body member, said flanges and said channel portions adapted to engage complimental channel portions in the rail.

17. For use in a rail system having a hollow rail, a rail connector comprising a body member having an external transverse cross-section conforming to the internal cross-section of a rail and having respective upper, lower and side walls, said body member having an internal transverse cross-section comprising: first and second channel elements defining connecting points on said connector, said first channel elements being disposed adjacent to the upper wall of said body member and said second channel elements being disposed adjacent to the lower wall of said body member; third and fourth channel elements defining connecting points on said connector, said third and fourth channel elements being disposed adjacent to intersections of said upper and side walls of said body member; fifth and sixth channel elements defining connecting points on said connector, said fifth and sixth channel elements being disposed adjacent to intersections of said lower wall and said side walls of said connector; a mounting plate adapted to be coupled to a support surface, said mounting plate having means thereon to facilitate coupling of said plate to a support surface and holes therein positioned to register with connecting points of said body member, said body member adapted to be coupled to said mounting plate by fasteners extending through said mounting plate into engagement with connecting points in said body member, said means facilitating coupling of said mounting plate to a support surface comprising an offset portion, and said offset portion of said mounting plate facilitating flush mounting of said plate to support a surface.

* * * * *